United States Patent [19]

Miyazaki

[11] Patent Number: 4,915,025

[45] Date of Patent: Apr. 10, 1990

[54] ANVIL CYLINDER FOR PROCESSING MACHINE

[75] Inventor: Hidetaka Miyazaki, Kasugai, Japan

[73] Assignee: Isowa Industry Co., Ltd., Nagoya, Japan

[21] Appl. No.: 296,891

[22] Filed: Jan. 12, 1989

Related U.S. Application Data

[63] Continuation of Ser. No. 22,127, Mar. 5, 1987, abandoned.

[30] Foreign Application Priority Data

Mar. 7, 1986 [JP] Japan ..... 61-032885[U]

[51] Int. Cl.[4] ..... B41F 23/04

[52] U.S. Cl. ..... 101/424.1; 101/183

[58] Field of Search ..... 101/424.1, 183; 493/324

[56] References Cited

U.S. PATENT DOCUMENTS

| | | | |
|---|---|---|---|
| 1,075,809 | 10/1913 | Benson | 101/416 A |
| 1,650,339 | 11/1927 | Fischer | 101/416 A |
| 2,081,583 | 5/1937 | Fitchett | 493/324 |
| 2,085,435 | 6/1937 | Lohmann | 493/324 X |
| 2,110,212 | 3/1938 | Fitchett | 493/53 X |
| 2,129,277 | 9/1938 | Jeuck | 101/416 R |
| 2,674,942 | 4/1954 | Rockstrom | 493/53 X |
| 2,941,062 | 6/1960 | Halley | 101/424.1 |
| 3,142,233 | 7/1964 | Downie | 493/324 |
| 3,349,702 | 10/1967 | Nesin et al. | 101/416 R |
| 3,446,142 | 5/1969 | Vandenberg | 101/424.1 |
| 4,471,693 | 9/1984 | Tsukasaki | 493/324 |
| 4,527,788 | 7/1985 | Masuda | 493/324 |
| 4,596,546 | 6/1986 | Schellenberg | 493/324 |

FOREIGN PATENT DOCUMENTS

| | | | |
|---|---|---|---|
| 588810 | 6/1947 | United Kingdom | 83/170 |

OTHER PUBLICATIONS

I.B.M. Technical Disclosure Bulletin, vol. 14, No. 9 Feb. 1972, "Card Dryer-Conveyor", T. M. Wright.

*Primary Examiner*—Edgar S. Burr
*Assistant Examiner*—Aaron J. Lewis
*Attorney, Agent, or Firm*—Cushman, Darby & Cushman

[57] ABSTRACT

An anvil cylinder for use in a processing machine, which is installed in parallel with a cylinder equipped with a processing tool such as a die cutting tool. The anvil cylinder comprises a heating means by which the cylinder is so heated as to make dry the ink transferred thereonto from a sheet to be processed thereby.

1 Claim, 2 Drawing Sheets

ANVIL CYLINDER FOR PROCESSING MACHINE

BACKGROUND OF THE INVENTION

1. Field of the Invention

The present invention relates to an anvil cylinder for use in a processing machine which, when subjecting a sheet to processing operations such as punching after subjecting the same to printing, can prevent the sheet from being stained with ink and, more particularly, to an anvil cylinder for use in a processing machine which is suitable for being used to subject a corrugated board sheet to printing, ruling and punching so as to make a packing case.

2. Description of the Prior Art

Conventionally, in a processing machine for a corrugated board, a multiplicity of corrugated board sheets are stocked in the form of laminated or stacked sheets, the lowermost sheet being delivered from a sheet feeding unit to a printing unit in which the sheet is printed in one color, or in two or more colors. Subsequently, the sheet is fed to a creaser slotter unit in which the sheet is subjected to ruling. Subsequently, the sheet is fed into a rotary die cutter unit so as to be subjected to punching such as that for making a finger engagement bore. The ink which is applied to the sheet in the printing unit is of a quick-drying type. The feeding and conveying of the sheet to each processing unit, however, have in recent years been effected at high speed so as to cause an increase in the rate of operation. For this reason, the sheet was frequently punched, after having been printed, by a rotary die cutter in a state wherein the ink has not yet been dried up sufficiently. As a result, the ink was transferred from the non-dried printed surface of the corrugated board sheet onto the outer periphery of the anvil cylinder. The ink thus transferred thereonto was further transferred onto another succeeding sheet as a result of punching the same in a state wherein that ink has not yet been dried up. In consequence, the succeeding sheet was stained with the ink. In the prior art, transfer of ink from the sheet to the anvil cylinder and vice versa thus occur repeatedly each time the punching is carried out. This furthers the stain of the sheet with ink, resulting in a degradation of the product quality.

SUMMARY OF THE INVENTION

In view of the above, the object of the present invention is to provide an anvil cylinder for use in a processing machine, which, even when subjecting a sheet, which is fed at high speed, to, for example, punching in a state wherein the printed ink has not yet been dried up, is capable of effectively preventing another immediately succeeding sheet from being stained with the ink which has been transferred from the preceding printed sheet onto the anvil cylinder.

To attain the above object, according to the present invention, there is provided an anvil cylinder for use in a processing machine, installed in parallel with a cylinder including a processing tool such as that for die cutting, comprising a heating means.

BRIEF DESCRIPTION OF THE DRAWINGS

An anvil cylinder for use in a processing machine according to an embodiment of the present invention is illustrated in the drawings in which.

DESCRIPTION OF THE PREFERRED EMBODIMENTS

Figure 1:
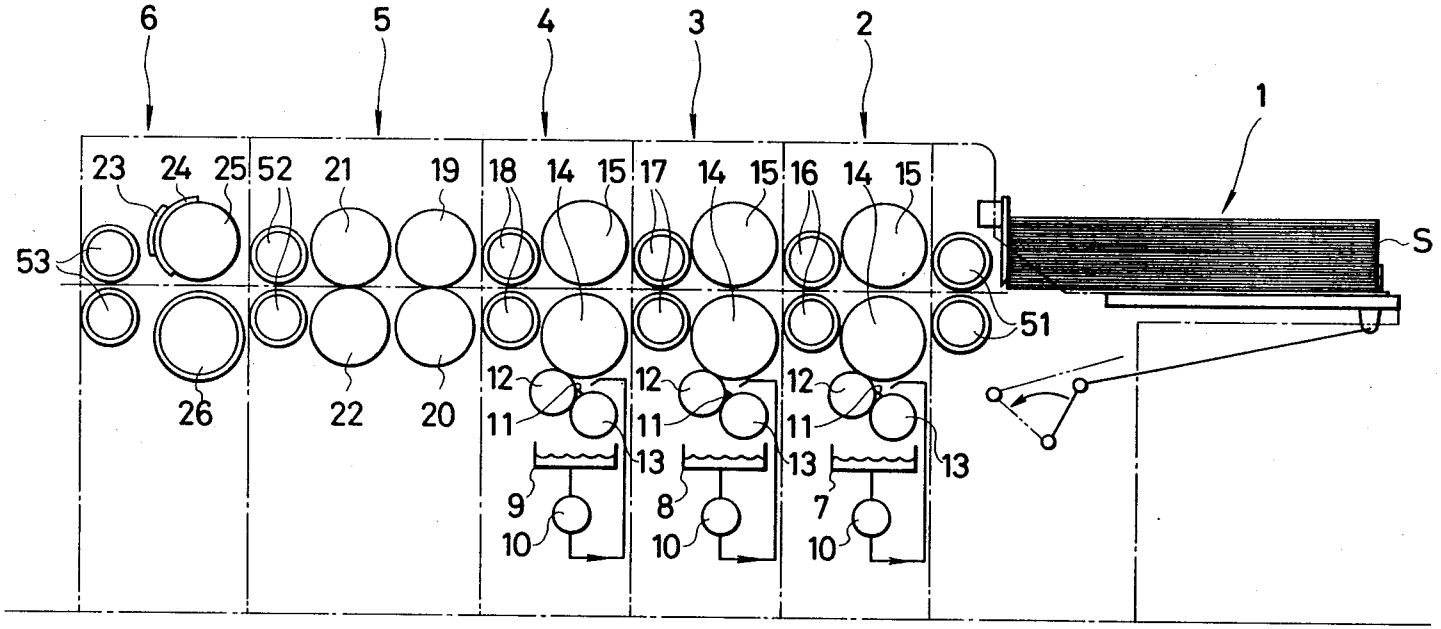
FIG. 1 illustrates the construction of the processing machine arranged to effect printing, ruling and punching of a sheet of corrugated cardboard.
Figure 2:
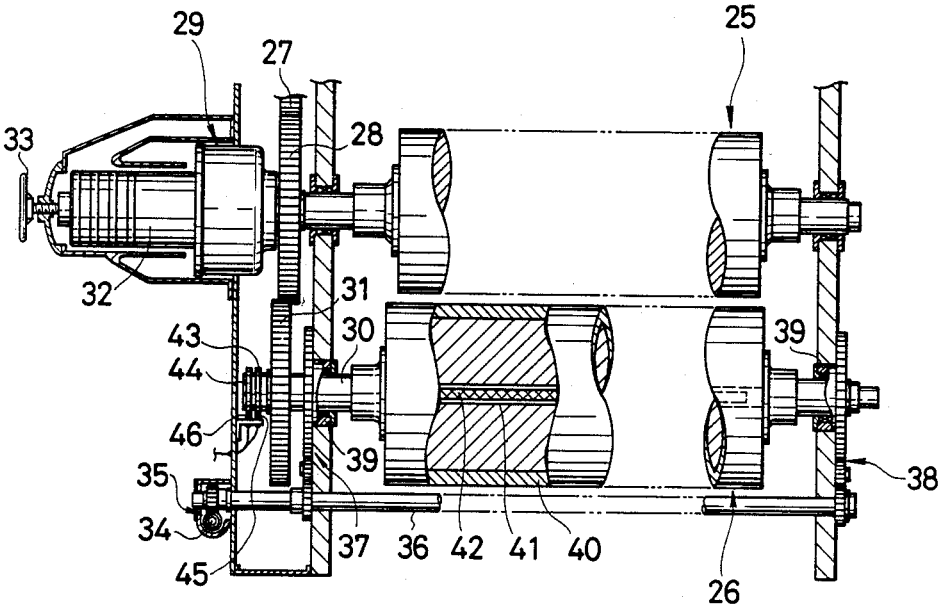
FIG. 2 illustrates the structure of a rotary die cutter.

An anvil cylinder for use in a processing machine according to an embodiment of the invention will now be described with reference to the drawings. FIG. 1 illustrates an anvil cylinder which has been applied, by way of example, to a rotary die cutter unit of the processing machine for processing of a corrugated cardboard sheet through operations of its series of processing units. Reference numeral 1 denotes a sheet feeding unit, 2 a first printing unit, 3 a second printing unit, 4 a third printing unit, 5 a creaser slotter unit, and 6 the rotary die cutter unit. The units 1 to 6 are adapted to be incorporated into a working line so that they may be retreated from the line when not required. With regard to the printing units 2 to 4 in particular, in a case where one-color printing is performed on the corrugated cardboard sheet S, the unit alone, among the units 2 to 4, which can print with an ink having a designated color is incorporated, or participates, into the working line. On the other hand, where multi-color printing is carried out, the two or more units which can print, respectively, with two or more corresponding inks each of a designated different color is incorporated into the working line. The printing units 2 to 4 are comprised of pans 7 to 9 each having received therein an ink of a predetermined color, anilox rolls 12 and doctor rolls 13 between which are formed ink pools 11 into which the inks in the pans 7 to 9 are introduced by operation of pumps 10, printing cylinders 14 each having transferred thereto a specified amount of ink from the anilox roll 12 to transfer the same onto the sheet S, press rolls 15 for clamping the sheet S between themselves and the printing cylinders 14, and three pairs of feed rolls 16 to 18, respectively. In this embodiment, the "bottom printing" system is adopted in which printing is effected on the bottom of the sheet S. The "top printing" system, however, may also be applicable. The creaser slotter unit 5 is comprised of upper blades 19, 21, lower blades 20, 22 and a pair of feed rolls 52, 52. The upper blade 19 and lower blade 20 are used to make ruled lines while the upper blade 21 and lower blade 22 are used to make elongate slits, cutouts, or the like. As understood, the area of contact between the surface of the sheet S and the upper blade 19, 21 or lower blade 20, 22 is very small. Yet, there are not a few occasions in which the lower blades 20 and 22 in particular are disposed at positions free of contact with the printed surface of the sheet S. For this reason, it is almost impossible that the lower blades 20, 22 cause a stain of the surface of the sheet S having been inked by the printing units 2 to 4, even when the ink thereon has not yet been dried up. On the other hand, the rotary die cutter unit 6 is comprised of a die cylinder 25 mounted, via a holder 24, with a cutting blade 23 so shaped as to permit a punching of the sheet S, an anvil cylinder 26 adapted to receive the cutting blade 23 of the die cylinder 25, and a pair of upper and lower feed rollers 53. The die cylinder 25 is adapted to be rotated about its axis by way of a gear 27, a gear 28 and a differential device 29 which are driven in turn by a drive source. The gear 28 is meshed with a gear 31 mounted on a rotation shaft 30 of the anvil cylinder 26. The differential device 29 is Arranged such that when a motor 32 has been driven, since the gear 28 is non-rotated because of its being meshed with the gear 27, the die cylinder 25 alone is permitted to be rotated about its axis. This enables a positioning, in the sheet-feeding direction, of the cutting blade 23 relative to the sheet S. Further, when an operator rotates a handle 33, the die cylinder 25 is moved in the axial direction. This enables a positioning, in the axial direction, of the cutting blade 23 relative to the corrugated cardboard sheet S. Further, when the operator rotates a handle shaft 34, an eccentric bush 39 is rotated via a gear group 35, a transmission shaft 36 and gear groups 37 and 38. As a result, since the anvil cylinder 26 is supported by the eccentric bush 39 in such a manner that its axis is located at a position displaced from the center thereof, the anvil cylinder 26 is moved in a direction in which it moves toward, or away from, the die cylinder 25. This makes it possible to adjust the gap between the die cylinder 25 and the anvil cylinder 26 so as to permit that gap to be in conformity with the thickness of the sheet S. The anvil cylinder 26 to be subsequently described may be not only of a "soft-cut" type wherein it has in its peripheral portion a blade-receiving layer 40 which consists of synthetic resin such as urethane and which is adapted to receive the cutting blade 23 of the die cylinder 25, or but also of a "hard-cut" type wherein it has in its peripheral portion stacked iron plates with cushion materials interposed therebetween.

According to the invention, the anvil cylinder 26 is formed interiorly with a receiving bore 41 in which there is received an electric heater 42 serving as heating means. The electric heater 42 is connected to two bipolar slip rings 43, 44 provided on an end of the rotation shaft 30 so as to have passed therethrough an electric current from an external power source by way of brushes 45, 46 and slip rings 43, 44. Preferably, the electric heater 42 is disposed at that position in the interior of the anvil cylinder 26 which is as close to the outer periphery thereof as possible. Needless to say, when the printing units 2 to 4 are arranged in accordance with the top printing system, the anvil cylinder 26 is disposed on the upper side, while the die cylinder 25 on the lower side, of the working line.

In FIG. 1, reference numerals 51, 52 and 53 denote pairs of feed rollers, respectively.

In operation, the corrugated cardboard sheet S which has been delivered from the sheet feeding unit 1 is printed, by a specified one or ones of the printing units 2 to 4, then, for example, ruled by the creaser slotter unit 5, and then punched, by the rotary die cutter unit 6, to make, for example, a finger engagement bore. At this time, the cardboard sheet S is fed or conveyed at high speed. Therefore, it is possible that the quick-drying ink having been applied onto the sheet surface by such specified printing unit or units is not sufficiently dried up even when the sheet is punched. For this reason, the ink may be transferred, at the time of punching, from the surface of the sheet S onto the outer circumferential periphery of the anvil cylinder 26. According to the invention, however, such ink is dried up at once at such periphery of the anvil cylinder 26. This eliminates the possibility that, at the time of punching a second immediately succeeding sheet S, transfer of ink occurs from the inked peripheral surface of the anvil cylinder 26 onto the surface of such second succeeding sheet S. The temperature at which the anvil cylinder 26 is heated by the electric heater 42 may be suitably selected in accordance with various conditions such as the nature of the ink used in the printing units 2 to 4.

Figure 3:
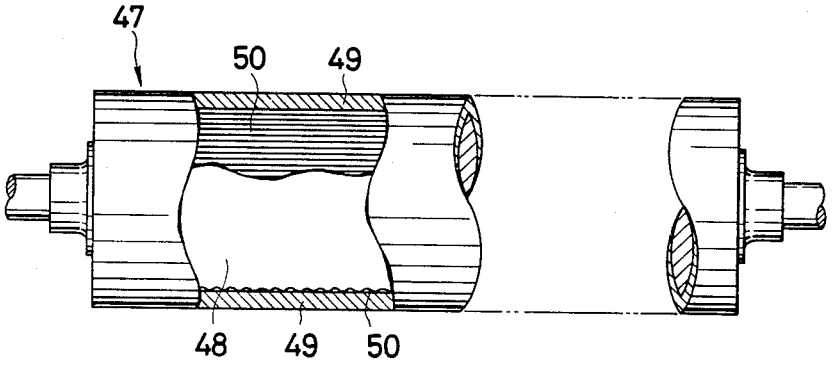
FIG. 3 is a front view, partly broken away, of an anvil cylinder according to another embodiment of the invention.

FIG. 3 illustrates another embodiment of the present invention in which an electric heater 50 is interposed between a base material 48 of the anvil cylinder 47 and a blade-receiving layer 49 or iron plate. By this construction, the embodiment aims at heating the outer periphery of the anvil cylinder 47 to the highest possible degree.

As has been described above, according to the invention, even when the sheet is, for example, punched in a state wherein the ink applied thereon by printing stands as it is not sufficiently dried up as a result of high-speed feeding or conveyance of the sheet, the ink which has been thus transferred from the sheet onto the anvil cylinder is soon completely dried up due to the temperature of the anvil cylinder raised by the heating means incorporated therein. This effectively prevents such ink from being transferred, as in the prior art, from the anvil cylinder onto a sheet to be next processed and thus staining the latter. Thus, a great advantage is offered in regard to utilizing the rotary die cutter unit.

What is claimed is:

1. A cardboard processing machine for subjecting a sheet of cardboard material fed along a conveyance path therethrough to a plurality of processing operations comprising:

means for printing on a sheet of cardboard material fed along the conveyance path;

means for punching and ruling a sheet of cardboard material including a rotary die cutter downstream of said means for printing;

an anvil cylinder mounted downstream of said printing means along said conveyance path, said anvil cylinder being mounted for rotation about a longitudinal axis thereof for supporting the sheet of cardboard fed along the conveyance path in opposition to said means for punching and ruling the sheet, said anvil cylinder being provided so as to contact a printed surface of the printed cardboard sheet printed by said means for printing; and means for preventing smudging of the next conveyed cardboard sheet by ink transferred to said anvil cylinder by a previous cardboard sheet including means for directly heating the outer surface of said anvil cylinder by means of a heater provided in the interior wall of said anvil cylinder whereby printing ink transferred to said anvil cylinder when the printed sheet of cardboard is conveyed between said anvil cylinder and said punching and ruling means is quickly heated and dried thereon by the heat directly transmitted by means of said heater from the interior wall of said anvil cylinder to the outer surface of said anvil cylinder thereby preventing the transference of said transferred printing ink to a next conveyed cardboard sheet.

* * * * *